US008264148B2

(12) United States Patent
Loeffler et al.

(10) Patent No.: US 8,264,148 B2
(45) Date of Patent: Sep. 11, 2012

(54) DISCHARGE LAMP

(75) Inventors: Gerhard Loeffler, Eichstaett (DE); Dirk Rosenthal, Gaimersheim (DE); Swen-Uwe Baacke, Neuburg/Donau (DE)

(73) Assignee: Osram AG, Munich (DE)

( * ) Notice: Subject to any disclaimer, the term of this patent is extended or adjusted under 35 U.S.C. 154(b) by 76 days.

(21) Appl. No.: 12/682,266

(22) PCT Filed: Oct. 9, 2007

(86) PCT No.: PCT/EP2007/060706

§ 371 (c)(1),
(2), (4) Date: Apr. 9, 2010

(87) PCT Pub. No.: WO2009/049660

PCT Pub. Date: Apr. 23, 2009

(65) Prior Publication Data

US 2011/0260597 A1 Oct. 27, 2011

(51) Int. Cl.
*H01J 17/18* (2006.01)
*H01J 61/36* (2006.01)

(52) U.S. Cl. ..... 313/623; 313/331

(58) Field of Classification Search ..... 313/623, 313/634, 331, 332, 495–497
See application file for complete search history.

(56) References Cited

U.S. PATENT DOCUMENTS

| | | | |
|---|---|---|---|
| 3,250,941 | A | 5/1966 | Wilson et al. |
| 6,741,035 | B2 | 5/2004 | Matsushima et al. |
| 7,279,839 | B2 | 10/2007 | Menzel et al. |
| 2003/0151364 | A1 | 8/2003 | Matsushima et al. |
| 2004/0100196 | A1 | 5/2004 | Chiba |

FOREIGN PATENT DOCUMENTS

| | | | |
|---|---|---|---|
| JP | 2003242932 | A | 8/2003 |
| WO | 03075310 | A1 | 9/2003 |

OTHER PUBLICATIONS

International Search Report of PCT/EP2007/060706 mailed on Jul. 29, 2008.

*Primary Examiner* — Joseph L Williams

(57) ABSTRACT

A discharge lamp may include a substantially ellipsoidal discharge vessel that surrounds an anode and a cathode that are respectively fixed by current-carrying electrode holders, the latter being guided through bulb shafts arranged diametrically on the discharge vessel, there being provided around the electrode holders at the transition from the discharge vessel to the bulb shafts constrictions that form a connecting channel between the discharge space, surrounded by the discharge vessel, and in each case the bulb shaft spaces surrounded by the bulb shafts, wherein at least one of the discharge vessel, the constrictions and the anode coating is designed in such a way as to reduce or avoid blackening of the discharge vessel in the light-emitting region.

9 Claims, 1 Drawing Sheet

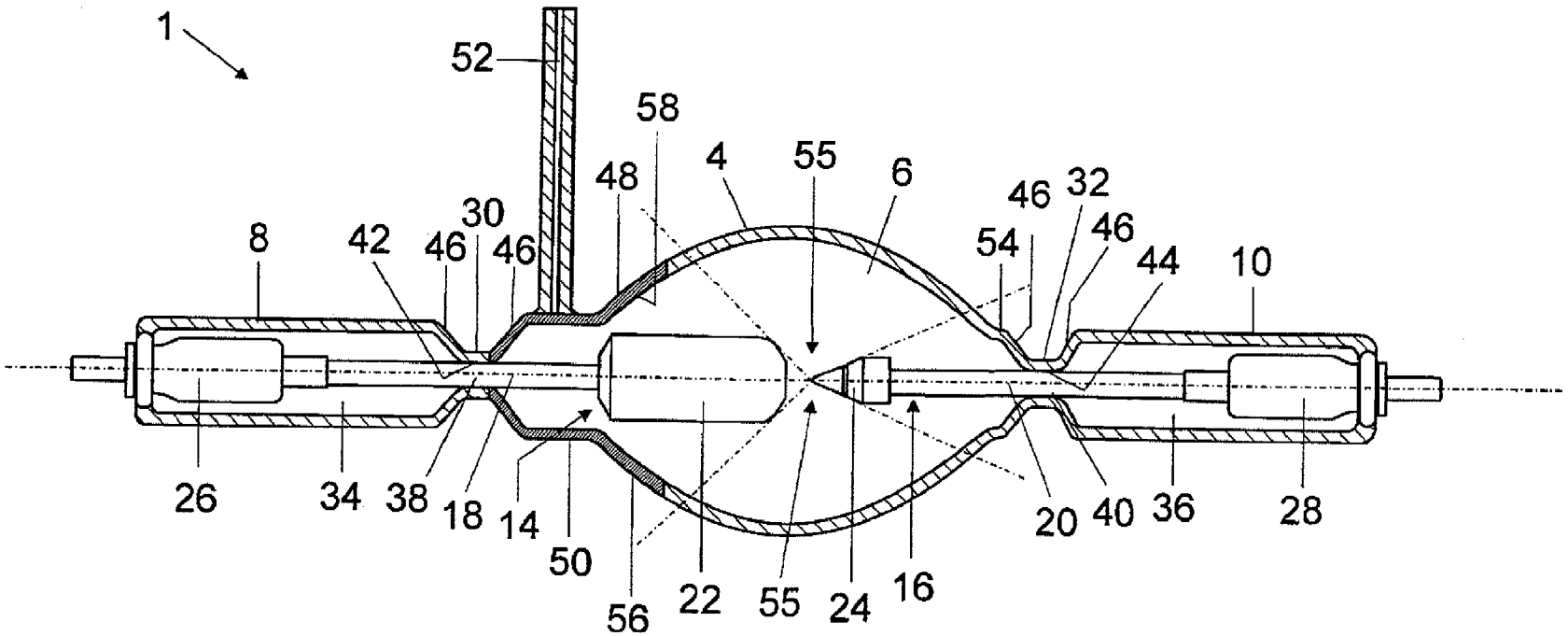
1
8
26
34
42
46
30
46
52
48
58
4
55
6
46
54
32
46
44
10
28
36
40
20
16
24
55
22
56
50
14
18
38

DISCHARGE LAMP

RELATED APPLICATIONS

The present application is a national stage entry according to 35 U.S.C. §371 of PCT application No.: PCT/EP2007/060706 filed on Oct. 9, 2007.

TECHNICAL FIELD

Various embodiments relate to a discharge lamp.

BACKGROUND

Discharge lamps, in particular XBO® high pressure discharge lamps, have an ellipsoidal lamp bulb that surrounds an anode and a cathode. The service life of such discharge lamps is determined, inter alia, by the blackening of the lamp bulb that occurs during operation and leads to a substantial loss in useful light. The blackening has various causes. One of them is the evaporation of anode material on the basis of the high temperatures during operation of the high pressure discharge lamp, said material being deposited on the inner surface of the lamp bulb. A further cause of the blackening are contaminations of the gas fill in the lamp bulb, for example atmospheric residues such as oxygen and moisture that can be removed only with a high outlay on time and cost during the production of the high pressure discharge lamp.

There have been various approaches to date for minimizing the blackening. For example, use is made of relatively large lamp bulbs such that deposits can be distributed over a relatively large area, the blackening continuing to occur in weakened form, nevertheless. A further approach to this solution is to use large volume anodes in order to lower the anode temperature during operation by means of a large emission area, and thus to reduce the evaporation of anode material.

SUMMARY

Various embodiments provide a high pressure discharge lamp that has a long service life in conjunction with a substantially maintained light intensity.

The inventive discharge lamp has a substantially ellipsoidal discharge vessel that surrounds an anode and a cathode that are respectively fixed by current-carrying electrode holders, the latter being guided through bulb shafts arranged diametrically on the discharge vessel, there being provided around the electrode holders at the transition from the discharge vessel to the bulb shafts constrictions that form a connecting channel between the discharge space, surrounded by the discharge vessel, and in each case the bulb shaft spaces surrounded by the bulb shafts, in which case the discharge vessel, the constrictions and/or the anode coating are designed in such a way as to reduce or avoid blackening of the discharge vessel in the light-emitting region. This has the advantage that each individual one of these measures substantially increases the service life of a discharge lamp by comparison with the prior art, in conjunction with production costs that are approximately maintained.

The discharge vessel preferably has a cylindrical cooling section substantially between a side of the anode that is averted from the cathode, and a constriction. This has the advantage that, for example, evaporated anode material can accumulate in this region and that the discharge vessel is therefore blackened outside the optically useful region.

The cylindrical cooling section can advantageously have a diameter that is greater than the diameter of the cylindrical anode, and can have a length that corresponds substantially to half the length of the anode, thus enabling a sufficiently large cooling section for the deposition of, for example, evaporated anode material.

In a preferred embodiment, the anode is coated with a coating, preferably with a tungsten paste, that improves the emission. This has the advantage that the emission of the discharge lamp is increased, while the anode has a lower temperature and can therefore evaporate less anode material.

The connecting channels can be embodied in such a way that they ensure the relative position of the electrode holders in the case of minimum exhaust resistance in the production process, thus enabling a simpler and more cost effective pumping off of atmospheric residues.

The diameter and/or the length of the connecting channel can be minimized in order advantageously to achieve the minimum exhaust resistance.

Walls can be positioned obliquely with reference to the electrode holders in the transition region between the constrictions and the bulb shafts and in the transition region between the constrictions and the discharge vessel.

The discharge vessel has, for example, a cylindrical section approximately between a side, averted from the anode, of the cathode and the constriction, it thereby being possible to effect a mechanically stable transition from the discharge vessel to the constriction.

An exhaust tube is preferably formed on the cooling section.

BRIEF DESCRIPTION OF THE DRAWINGS

The drawing is not necessarily to scale, emphasis instead generally being placed upon illustrating the principles of the invention. In the following description, various embodiments of the invention are described with reference to the following drawing, in which the FIGURE shows a longitudinal section through a discharge lamp in accordance with an embodiment.

DETAILED DESCRIPTION

The following detailed description refers to the accompanying drawings that show, by way of illustration, specific details and embodiments in which the invention may be practiced.

The invention is explained below with the aid of an XBO® high pressure discharge lamp that is used, for example, in projection systems and spotlights.

The FIGURE shows a schematic of an XBO® high pressure discharge lamp 1 with a base at both ends using short-arc technology.

Said lamp has a discharge vessel 4 made from quartz glass with a discharge space 6 and two sealed bulb shafts 8, 10 arranged diametrically on the discharge vessel 4 and whose free end sections can be provided respectively with a base sleeve (not illustrated). Two electrodes 14, 16 running in the bulb shafts 8, 10 and between which a gas discharge occurs during operation of the lamp protrude into the discharge space 6. Enclosed in the discharge space 6 of the discharge vessel 4 is an ionizable fill that substantially consists of high purity xenon. In the illustrated exemplary embodiment, the electrodes 14, 16 are respectively embodied as a bipartite electrode system with a current-carrying, rod-shaped electrode holder 18, 20 and a discharge-side head electrode 22 (anode) or head electrode 24 (cathode) soldered to said holder. In accordance with the FIGURE, the right-hand electrode head 24 is embodied as a conical head cathode 24 or cathode for generating high temperatures in order to ensure a defined arc attachment and a sufficient electron flux on the basis of thermal emission and field emission (Richardson equation).

The left-hand electrode head 22 in the FIGURE is embodied as a barrel-shaped head anode 22 or anode subjected to a high thermal load, in the case of which the emission power is improved by sufficient dimensioning of the electrode size. In order to further increase the emission power, the surface of the head anode 22 is coated with a coating 25, preferably with a tungsten paste, as a result of which the head anode 22 has a higher emission coefficient of 0.55, and here an emission higher by approximately 40% by comparison with the prior art, where the emission coefficient is 0.4.

The rod-shaped electrode holders 18, 20 respectively have two bearing points. Here, one bearing point is respectively a current leadthrough system 26, 28 formed on the ends of the bulb shafts 8, 10, and the other bearing point is respectively a constriction 30, 32 arranged in the transition region between the discharge vessel 4 and the bulb shafts 8, 10. The current leadthrough systems 26, 28 support the electrode holders 18, 20 respectively in the radial and axial direction and are sealed in an airtight fashion against the environment such that no air can intrude from outside into the bulb shaft spaces 34, 36 surrounded by the bulb shafts 8, 10. Said bulb shaft spaces are connected to the discharge space 6 of the discharge vessel 4 via connecting channels 38, 40 that are delimited by a cylindrical inner wall 42, 44 of the constrictions 30, 32 and the electrode holders 18, 20. The radial height of the connecting channels 38, 40, which is measured from the inner walls 42, 44 up to the surfaces of the electrode holders 18, 20, amounts on average to approximately 0.4 to 0.5 mm and is substantially higher than in the prior art, where this height corresponds to 0.1 to 0.2 mm. The axial length of the connecting channels 38, 40 amounts approximately to 1.5 times the cross section of the electrode holders 18, 20.

The constrictions 30, 32 have the same wall thickness as the bulb shafts 8, 10, and are delimited by obliquely positioned walls 46 in the transition region to the discharge vessel 4 and to the bulb shafts 8, 10. The axial length of the constrictions 30, 32 is minimized, and the radial height of the connecting channels 38, 40 is maximized such that these dimensions are precisely sufficient to ensure the radial position of the electrode holders 18, 20.

Approximately between the shadow side 48, averted from the head cathode 24, of the head anode 22, and the wall 46, the right-hand one in the FIGURE, of the left-hand constriction 30, the discharge vessel 4 has a substantially cylindrical cooling section 50 whose diameter is somewhat larger than the diameter of the head anode 22, and whose axial length corresponds approximately to half the axial length of the head anode 22. In the FIGURE, there is arranged radially on the outer periphery of the cooling section 50 an exhaust channel 52 that is used during the production process—described further below—of the high pressure discharge lamp 1, and can be removed after production. A further cylindrical section 54 is formed on the end, opposite the cooling section 50, of the discharge vessel 4 and has a substantially shorter axial length.

The high pressure discharge lamp 1 has an optical useful region 55 that is marked by four dashed and dotted lines, the light being substantially emitted over this useful region 55 during operation.

In the prior art, after a certain period of operation during the use of a high pressure discharge lamp blackening occurs on the inner wall of the discharge vessel and becomes thicker and darker as the period of operation lengthens. Here, this blackening is located in an optically useful region and therefore reduces the useful light of the high pressure discharge lamp until the latter can no longer be used. One cause of the blackening are the high temperatures of the anode during operation of the lamp, which lead to an evaporation of the anode material, which is then deposited on the inner wall of the discharge vessel. A further cause are contaminations of the fill of the discharge vessel with, for example, oxygen and moisture, which contaminations can likewise be deposited in the form of a blackening.

In the case of the inventive high pressure discharge lamp 1 in the FIGURE, by contrast with the prior art a blackening 56 advantageously bears outside the optical useful region 55 substantially against the bulb inner surface 58 of the discharge vessel 4 in the region of the cooling section 50, in the transition region between the cooling section 50 and the remainder of the discharge vessel 4, and against the wall 46 between the cooling section 50 and the constriction 30, this being indicated in the FIGURE by a black coloring of the discharge vessel 4. Moreover, by comparison with the prior art the blackening 56 is substantially lower for the same period of operation. The reasons for this are explained below.

During production of the high pressure discharge lamp 1, gas still present in the discharge vessel 4, for example air, is exhausted as far as possible from the discharge space 6 via the exhaust channel 52, and from the bulb shaft spaces 34, 36 via the connecting channels 38, 40. Subsequently, the discharge vessel 4 is filled with an ionizable fill and sealed in an airtight fashion. Owing to their dimensioning, the connecting channels 38, 40 here exert the highest exhaust resistance in the high pressure discharge lamp 1. For this reason, the connecting channels 38, 40 are dimensioned so as to have maximum height with minimum axial length, in order to minimize the exhaust resistance, a sufficient radial support still being ensured for the electrode holder 18, 20. On the one hand, by comparison with the prior art this enables the high pressure discharge lamp 1 to be evacuated in a shorter time and an exhaust resistance up to 10 times smaller, and thus permits the production costs to be reduced and, on the other hand, permits the air residues such as oxygen and moisture to be minimized, since a larger quantity of air can be exhausted. The quality of the ionizable fill is improved as a result. Smaller quantities of air residues then lead to a lesser blackening 56 of the discharge vessel 4 during operation of the high pressure discharge lamp 1.

Owing to the higher emission of the head anodes 22 coated with tungsten, said anodes are at a lower temperature, as a result of which less anode material is evaporated, and thus the blackening 56 is likewise less. Furthermore, owing to the higher emission, inter alia the optical useful region 55 between the head anode 22 and discharge vessel 4 is heated up more strongly than in the prior art. The cooling section 50 of the discharge vessel 4 is shaded in by the head anode 22, and so the temperature is lower in this region than in the remainder of the discharge vessel 4. Evaporated anode material and contaminations of the fill are deposited in this cooling section 50 and lead to the blackening 56, which is situated outside the optical useful region 55.

Owing to the abovedescribed inventive features, no blackening 56, or only a slight one, occurs in the optical useful region 55, the result being the lengthening of the service life of the high pressure discharge lamp 1 by up to 50% by comparison with the prior art.

What is disclosed is a discharge lamp having a substantially ellipsoidal discharge vessel that surrounds an anode and a cathode that are respectively fixed by current-carrying electrode holders, the latter being respectively guided through bulb shafts arranged diametrically on the discharge vessel. Formed around the electrode holders at the transition from the discharge vessel to the bulb shafts are constrictions that have a connecting channel between the discharge space, surrounded by the discharge vessel, and in each case the bulb shaft space surrounded by the bulb shafts. The discharge vessel, the constrictions and/or the anode coating are designed in such a way as to reduce or avoid blackening in the optical useful region of the discharge lamp.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A discharge lamp, comprising:

a substantially ellipsoidal discharge vessel that surrounds an anode and a cathode that are respectively fixed by current-carrying electrode holders, the latter being guided through bulb shafts arranged diametrically on the discharge vessel, there being provided around the electrode holders at the transition from the discharge vessel to the bulb shafts constrictions that form a connecting channel between the discharge space, surrounded by the discharge vessel, and in each case the bulb shaft spaces surrounded by the bulb shafts wherein at least one of the discharge vessel, the constrictions and the anode coating is designed in such a way as to reduce or avoid blackening of the discharge vessel in the light-emitting region wherein the discharge vessel has a cylindrical cooling section substantially between a side of the anode that is averted from the cathode and a constriction wherein the cylindrical cooling section has a diameter that is greater than the diameter of the cylindrical anode.

2. The discharge lamp as claimed in claim 1, wherein the cylindrical cooling section has a length that corresponds substantially to half the length of the anode.

3. The discharge lamp as claimed in claim 1, wherein the anode is coated with a coating that improves the emission.

4. The discharge lamp as claimed in claim 3, wherein the anode is coated with a tungsten paste that improves the emission.

5. The discharge lamp as claimed in claim 1, wherein the connecting channels are configured in such a way that they ensure the relative position of the electrode holder in the case of minimum exhaust resistance in the production process.

6. The discharge lamp as claimed in claim 5, wherein at least one of the diameter and the length of the connecting channels are minimized.

7. The discharge lamp as claimed in claim 1, wherein walls are positioned obliquely with reference to the electrode holders in the transition region between the constrictions and the bulb shafts and in the transition region between the constrictions and the discharge vessel.

8. The discharge lamp as claimed in claim 1, wherein the discharge vessel has a cylindrical section substantially between a side, averted from the anode, of the cathode and the constriction.

9. The discharge lamp as claimed in claim 1, wherein an exhaust channel is formed on the cooling section.

* * * * *